United States Patent [19]

Gaudet

[11] 4,364,314

[45] Dec. 21, 1982

[54] SINGLE ROPE CABLEWAY WITH DETACHABLE HEAD CARRIAGES

[75] Inventor: Henri Gaudet, Bourg La Reine, France

[73] Assignee: Compagnie Miniere de l'Ogooue COMILOG, Neuilly, France

[21] Appl. No.: 176,801

[22] Filed: Aug. 11, 1980

[30] Foreign Application Priority Data

Aug. 27, 1979 [FR] France ..... 79 21623

[51] Int. Cl.[3] ..... B61B 12/12

[52] U.S. Cl. ..... 104/225; 104/180; 104/202

[58] Field of Search ..... 104/173 R, 173 ST, 180, 104/182, 197, 200–202, 204, 208, 225; 191/82, 83

[56] References Cited

U.S. PATENT DOCUMENTS

| | | | |
|---|---|---|---|
| 338,615 | 3/1886 | Roe et al. | 104/180 |
| 438,949 | 10/1890 | Roe | 104/225 X |
| 444,408 | 1/1891 | Finlayson | 104/200 |
| 530,902 | 12/1894 | Roe | 104/200 |
| 1,364,208 | 1/1921 | Rennie | 191/83 |
| 1,391,741 | 9/1921 | Liebenberg | 191/83 |

FOREIGN PATENT DOCUMENTS

| | | | |
|---|---|---|---|
| 1455899 | 9/1966 | France | 104/202 |
| 602455 | 3/1960 | Italy | 104/202 |

*Primary Examiner*—Randolph Reese

*Attorney, Agent, or Firm*—Stevens, Davis, Miller & Mosher

[57] ABSTRACT

Single rope aerial cableway having a load-carrying head carriage with two clips of inverted-V form for gripping the rope by the action of the weight of the load. Each clip is provided with a rearwards extending fork and is rotatably mounted to move the fork in a downward direction upon upward movements of the clip relatively to the rope so that the rope is engaged and guided by the fork. A finger engaging the rope is slidably mounted on the front side of the clip and the support sheave is provided with two side grooves.

3 Claims, 6 Drawing Figures

SINGLE ROPE CABLEWAY WITH DETACHABLE HEAD CARRIAGES

This invention relates to a single-rope cableway with detachable head carriages for bringing carriers to rest upon shunt rails at cableway terminal stations. Each head carriage comprises a pair of clips or grippers for securing the carriage to the rope, each clip having a solid form of inverted-V gripping onto the rope, the rope gripping pressure being applied by the weight of the carriage and of the load acting vertically. At the terminal stations the carriage is lifted relative to the rope by means of the wheels of the carriage engaging a shunt rail so as to be removed from the rope.

This known arrangement has turned out very well for non-passenger cableways because the head carriages are very simple and may be easily picked up and put down for uncoupling and securing the carriage to the rope. However, it has been found very inconvenient when the rope of the cableway is capable of vertical oscillations. When this happens there is a danger of the load falling off the rope.

It is the object of the present invention to remove this inconvenience and danger.

According to the construction of this invention, each clip is rotatably mounted on a horizontal transverse axis of the head carriage and each clip is provided with a fork which projects on the forward or rear portion of the clip so that this fork pivots downwards and engages the rope when the carriage and the clip are lifted from the rope. When the clip grips on the rope, the fork does not hinder the passing over the rope support sheave. The fork cooperates with the rope to prevent the load from falling off the rope, and during the following downward movement of the head carriage relative to the rope, the V-shaped surfaces of the clip again engage the rope. The length of the fork prongs corresponds to the maximal rope oscillation value. The fork advantageously projects on the rearside of the clip to avoid any shock when the clip meets the rope and the transverse axis is off-centered in such a manner that the clip is unbalanced and is turning downwards by its own weight.

It is another object of the invention to enable cableways to work with greater individual loads and steeper gradients. A known grip for cableways has on its wedge surfaces spiral grooves corresponding to the lay of the wires in the rope. When the diameter of rope and the spiral grooves are diminished due to wear, the gripping action will also diminish and slipping will occur. In accordance with the present invention, the clip is provided with a slidably mounted finger protruding between two adjacent strands of the rope. The finger is advantageously secured to the front portion of the clip in such a manner that during the process of engagement of the head carriage onto the rope, this finger engages the rope after the V-shaped wedge surfaces have met and secured the carriage to the rope.

A further object of this invention is to provide an improved rope support sheave which permits the passing of the clamps over the support sheave even if the rope is wholly engaged into the groove provided by the wedge surfaces of the clip, due to the wear of the rope or to a small angle between the wedge surfaces.

An embodiment of the invention is described by way of example with reference to the accompanying drawings in which.

Figure 1:
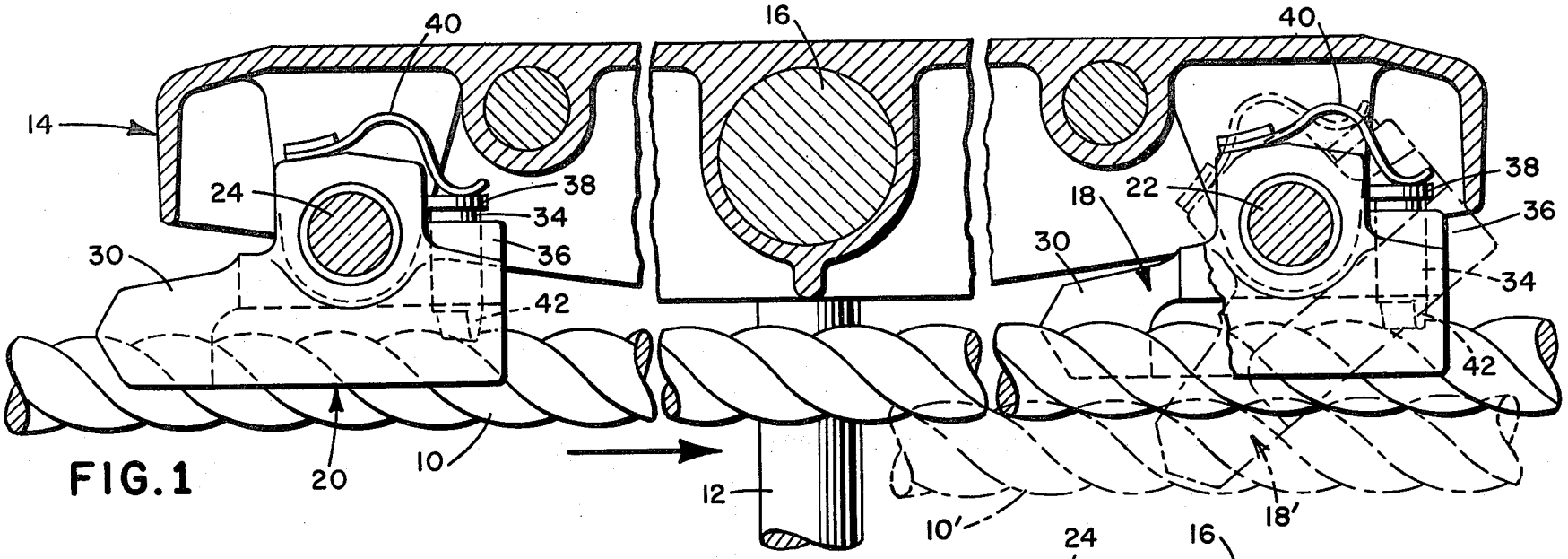
FIG. 1 is a longitudinal sectional view of a head carriage secured to the rope of a cableway.
Figure 6:
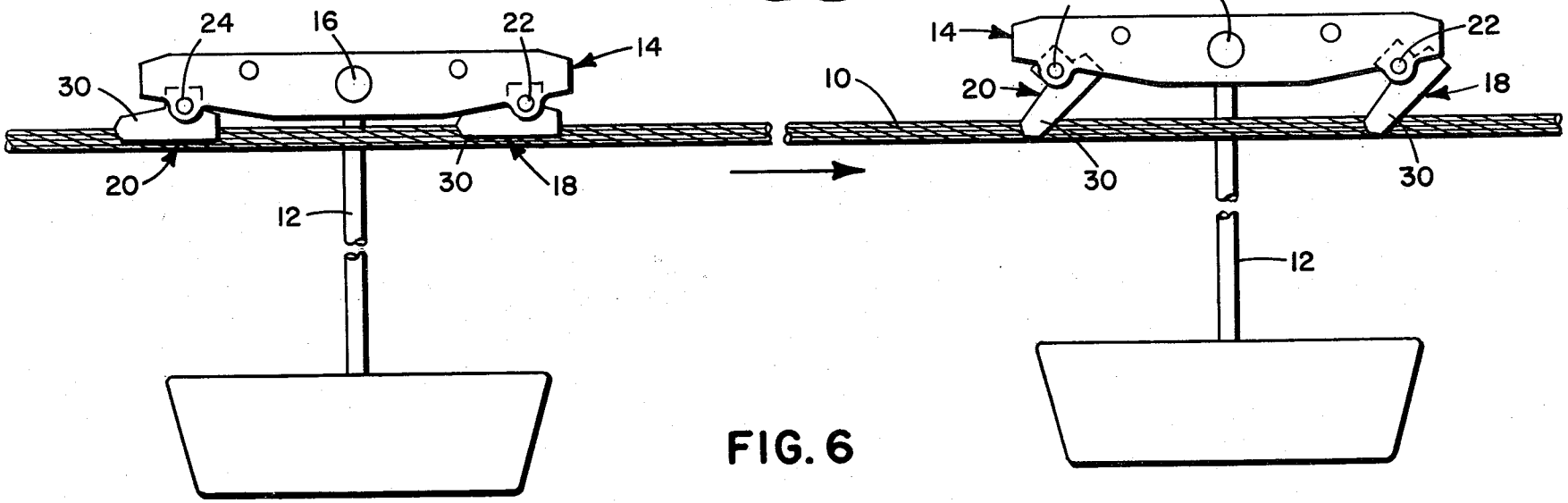
FIG. 6 is a side elevational view of the cableway.
Figure 2:
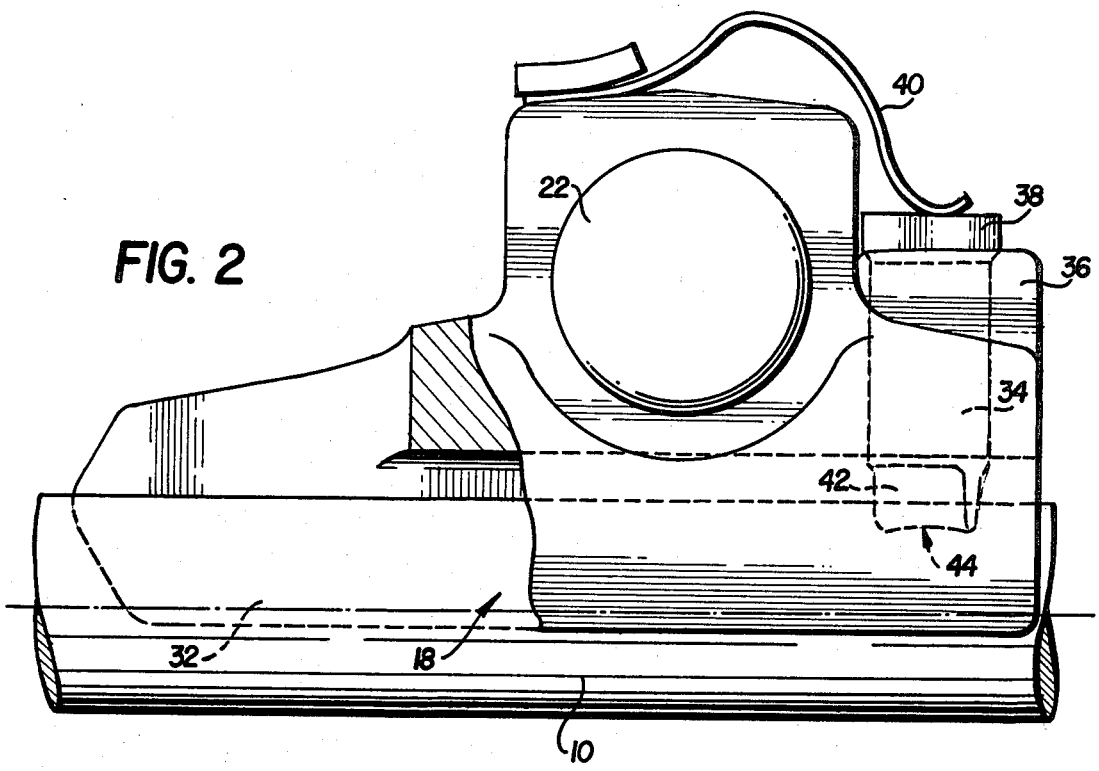
FIGS. 2, 3 and 4 are enlarged views respectively depicting elevation, top and side views of a clip of FIG. 1.
Figure 3:
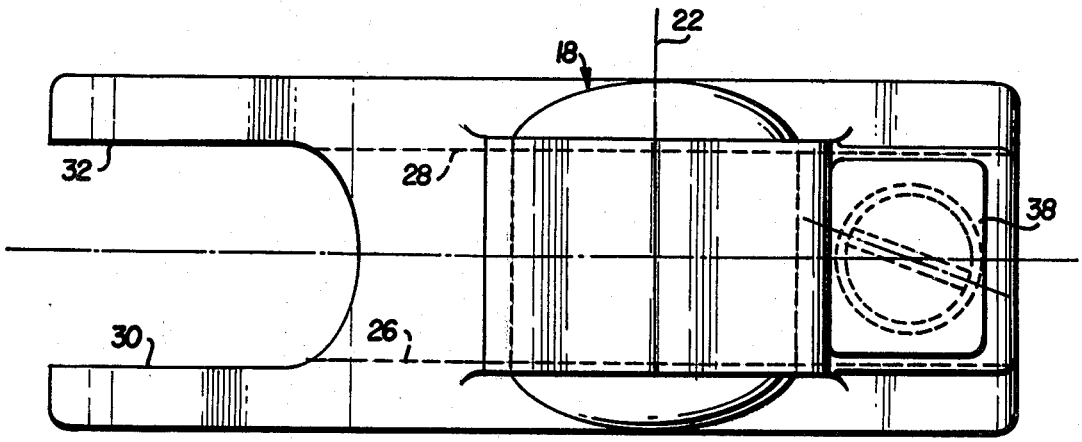

FIGS. 1 and 6 show a single-rope cableway having a rope 10 moved in an endless path for transporting materials. A load hanger 12 is pivotally connected to a head carriage 14 by a pin 16. The head carriage 14 comprises a pair of clips 18, 20 spaced apart in the lengthwise direction of the rope by which the carriage is secured to the rope 10 and guide rollers (not shown) for bringing the carriage to rest upon shunt rails at the terminal stations.

Each clip 18, 20 is pivotally connected to the frame of the carriage 14 by a pin 22, 24 transverse to the rope. Each clip comprises two wedge-shaped members 26, 28 of inverted V form. When the carriage 14 is secured to the rope 10 the inverted wedge-shaped members 26, 28 bear against opposite sides of the rope and grip the rope between them firmly, the weight of the head carriage and the load suspended on it by the hanger 12 tending to force the clip downwards, increasing the gripping force. At their rear ends with respect to the travel direction, each wedge member 26, 28 is formed or provided with a prong 30, 32 extending rearwards and forming a fork. When the clip 18, 20 grips the rope 10 the prongs 30, 32 extend substantially parallel to the rope and do not hinder the passing over the rope support sheaves. When the clip 18, 20 is lifted from the rope 10, it turns about the pin 22, 24 in the counter clockwise direction in FIG. 1, so that the fork prongs 30, 32 protrude downwards. The clip 18, 20 is urged into this swivelled position by a spring (not shown) and/or by the weight of the clip (position 18' shown by the dotted line on FIG. 1).

The cableway works in the following manner:

At the terminal station the head carriage 14 travels upon a shuntrail inclined downwardly to engage the rope 10. The clips 18, 20 grip the rope so as to secure the carriage 14 with the load to the rope 10. At the other terminal the carriage 14 is lifted off the rope by rolling onto an upwardly inclined shuntrail to uncouple the carriage 14 from the rope 10. In the lifted position of the carriage the clips 18, 20 are pivoted downwards and the fork 30, 32 of the clips engage the rope 10 first. Thereafter the wedge members 26, 28 meet the rope 10 and the clips will be automatically pivoted into the parallel gripping position. Further when the carriage 14 is temporarily lifted off the rope 10, for instance due to a vertical oscillation of the rope, the clips 18, 20 are pivoted downwards so that their forks 30, 32 are maintained against opposite sides of the rope and prevent the carriage from falling off the rope. At the end of the oscillation the clips 18, 20 come back to the gripping position. The forks 30, 32 are adapted for guiding the carriage when the latter is removed or coupled to the rope.

A finger 34 is slidably mounted in a vertical opening provided in the front part 36 of the clip 18, 20. A spring 40 biases the finger 34 into engagement with the rope 10 and a head 38 of the finger 34 limits this engagement. The extremity of the finger 34 projects through the bottom of the inverted-V groove 26, 28 and is shaped as an inclined knife 42. In the gripping position of the clip 18, 20 the knife 42 is inserted between two adjacent strands of the rope 10, the angle of the knife 42 corresponding to the lay of the wires of the rope 10. The edge 44 of the knife 42 is concavely curved so as to suit the rope 10 and the knife 42 is vertically movable so as to adjust the knife to any position of the clip 18, 20 with respect to the rope 10 and to allow for small variations in diameter of the ropes to which the clip is applied. It is clear that the gripping action of the clip is increased by the finger 34 engaging the rope 10 and so the ropeway will be able to work with greater individual loads and steeper gradients.

The finger 34 is provided at the forward end of the clip so that the finger is held out of contact of the rope 10 until the clip 18, 20 has been turned to the gripping position parallel to the rope and the wedge members 26, 28 have gripped the rope. The longitudinal spacing of the fingers 34 of the clips 18, 20 is arranged relative to the spiral strands of the rope 10 so that at least one finger 34 is inserted between two adjacent strands.

Figure 4:
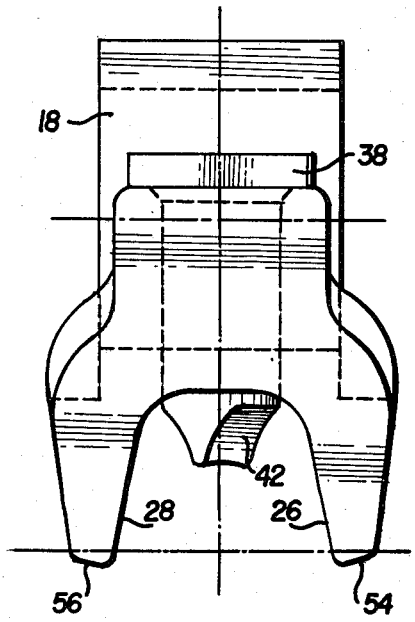
Figure 5:
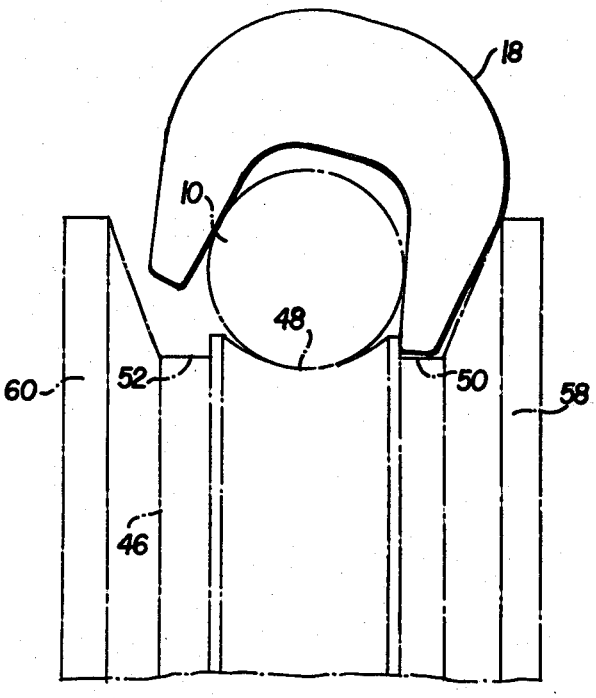
FIG. 5 is a side view of a clip passing over a sheave.

Referring more particularly to FIGS. 4 and 5, the figures show a rope support sheave 44 having side flanges 58, 60, a peripheral central rope receiving groove 48 for supporting the rope 10 and two adjacent side grooves 50, 52, the spacing of the latter side grooves corresponding to the spacing of the edges 54, 56 of the wedge members 26, 28. The width of the side grooves 50, 52 and the spacing of the side flanges 58, 60 are so arranged that the rope 10 always is biased towards the central groove 48. FIG. 5 shows clearly that the side grooves 50, 52 permit the passing over the sheave 46 of a clip 18 turned about its longitudinal axis, for instance under the action of a side wind or of a clip 18 gripping a rope having a diminished diameter, and fully inserted between the wedge members 26, 28.

I claim:

1. A single rope aerial cableway with a load support and haulage rope comprising;

a load carrying head carriage;

a pair of transverse axes spaced apart in lengthwise direction of the rope on said head carriage;

a pair of clips for securing the head carriage to the rope, each of said clips having a solid form of inverted-V for gripping the rope, said clips being rotatably mounted on one of the transverse axes;

a fork means on said clips containing a pair of prongs, adapted to extend in a parallel inoperative position relative to the rope in a gripping position of the clip, and to move in a vertical downward direction relative to the head carriage upon upward movement of the clip relative to the rope, the movement in a vertical downward direction causing the rope to become engaged and guided within the fork;

two pairs of opposite inclined wedge members adapted to grip the rope, one of said pairs of inclined wedge members being affixed to each of said clips, one of the said prongs being secured on the rear side of each wedge member so as to extend rearward substantially parallel to the rope in the gripping position of the clip; and a pair of fingers, each finger being slidably mounted on one of said clips, said fingers adapted to project between the wedge members and to engage the rope gripped between the wedge members, each finger being movable with respect to the wedge members and being capable of disengaging and then reengaging the rope during movement of the rope.

2. A single rope aerial cableway according to claim 1, wherein each of said fingers is slidably mounted on the front portion of said clips, each of the fingers having an edge adapted to project between two adjacent strands of the rope.

3. A single rope aerial cableway with a load support and haulage rope comprising:

a load carrying head carriage;

a pair of transverse axes spaced apart in lengthwise direction of the rope on said head carriage;

a pair of clips for securing the head carriage to the rope, each of said clips having a solid form of inverted-V for gripping the rope, said clips being rotatably mounted on one of the transverse axes;

a fork means on said clips containing a pair of prongs, adapted to extend in a parallel inoperative position relative to the rope in a gripping position of the clip, and to move in a vertical downward direction relative to the head carriage upon upward movement of the clip relative to the rope, the movement in a vertical downward direction causing the rope to become engaged and guided within the fork;

two pairs of opposite inclined wedge members adapted to grip the rope, one of said pairs of inclined wedge members being affixed to each of said clips, one of said prongs being secured on the rear side of each wedge member so as to extend rearward substantially parallel to the rope in the gripping position of the clip; and a pair of fingers, each finger being slidably mounted on the front portion of one of said clips, each of the fingers having an edge adapted to project between two adjacent strands of the rope, each finger being biased against the rope when the clip is in a gripping position while each finger is shifted relative to the clip and held out of contact with the rope when the clip is not in a gripping position.

* * * * *